US006865354B2

(12) United States Patent
Jackelen et al.

(10) Patent No.: US 6,865,354 B2
(45) Date of Patent: Mar. 8, 2005

(54) METHOD FOR USING A USER INTERFACE TO RESOLVE MISMATCHES BETWEEN PRINTER RESOURCES AND PRINT JOB REQUIREMENTS

(75) Inventors: Jeffrey A. Jackelen, Pittsford, NY (US); Edward M. Housel, Rochester, NY (US); Michael P. Tompkins, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 7 days.

(21) Appl. No.: 10/650,659

(22) Filed: Aug. 28, 2003

(65) Prior Publication Data

US 2004/0047643 A1 Mar. 11, 2004

Related U.S. Application Data

(60) Provisional application No. 60/407,388, filed on Aug. 30, 2002.

(51) Int. Cl.[7] ..... G03G 15/00
(52) U.S. Cl. ..... 399/81; 399/8; 399/9
(58) Field of Search ..... 399/9, 14, 11, 399/15, 18, 19, 20, 8

(56) References Cited

U.S. PATENT DOCUMENTS 5,129,639 A 7/1992 DeHority
6,661,978 B2 * 12/2003 Brewington ..... 399/19

* cited by examiner

*Primary Examiner*—Hoang Ngo
(74) *Attorney, Agent, or Firm*—Richard A. Romanchik

(57) ABSTRACT

A printer may detect a mismatch between print job attributes and available printer resources. The printer may then determine one or more options to correct the mismatch and may display these options on a user interface screen. The printer may then receive a selection of one of the options, for example from a printer operator. Based on the selection, the printer may take an action to resolve the mismatch.

31 Claims, 8 Drawing Sheets

METHOD FOR USING A USER INTERFACE TO RESOLVE MISMATCHES BETWEEN PRINTER RESOURCES AND PRINT JOB REQUIREMENTS

RELATED APPLICATIONS

This application claims priority to U.S. Provisional Patent Application Ser. No. 60/407,388 file date Aug. 30, 2002, entitled "Method For Using A User Interface To Resolve Mismatches Between Printer Resources And Print Job Requirements" and U.S. Utility patent application Ser. No. 10/232,633 entitled "Method of Resolving Mismatches Between Printer Resources and Print Job Requirements," and which are incorporated herein by reference in their entirety.

FIELD OF THE INVENTION

The invention relates generally to digital electrographic printing. More specifically, the invention relates to methods of detecting, notifying and resolving a printer mismatches.

BACKGROUND OF THE INVENTION

In order for a digital printer to successfully complete a print job, the print job attributes, such as specified media characteristics and finishing operations must be fully supported by the available printer resources and capabilities. That is, for example, the printer must support the necessary font, must be equipped with print media in the correct size and color and must be connected to the necessary finishing device to perform any required finishing operation. If the attributes specified by the print job are not supported by the printer, a "mismatch state" exists, and the printer will be unable to print the job, at least in the form the customer requested. The result is that the printer is either unable to print the job at all, or prints the job on different size paper, different color paper or without stapling or hole-punching the finished copies, for example.

Such a mismatch results in wasted time, in the case of a print job that cannot be run and requires reconfiguration of the print job attributes or printer resources, or in wasted time and money, in the case of print job being run on incorrect media or with incorrect or no finishing, requiring the print job to be completely re-run. Additionally, rendering by the raster image processor ("RIP") is a time consuming process and, therefore, many digital printers automatically check for potential mismatch conditions prior to initiating rendering.

DETAILED DESCRIPTION

For the sake of clarity, certain terms used herein may be ascribed the following definitions. The terms "raster," or "rasterize" are derived from the Latin rastrum, or "rake," and these terms are meant to refer to a method of representing an image as a two dimensional grid of pixels. The term "print job" or "job" refers to a collection of pages in a page description language (PDL) format such as PostScript or PCL, or a compressed image format, such as CCITT, including the "job attributes," i.e., directions to the raster image processor for printing the pages of the print job, such as media size and color, font, and the like. The term "raster image processor" or "RIP" refers to a collection of programs that translates a job in PDL format into a series of rasterized images and media descriptors for printing the job. The term "rendering" refers to creating a rasterized, or "rendered," image and media description from a single page of a print job. The first part of the print job submitted to the RIP is called the "print job header," which contains a series of specially formatted commands that define the job attributes. Additionally, a print job can be thought of as having a "life cycle," that may be divided into several different "job states" that span the life cycle of the print job. The first job state begins upon the job's arrival in the printer, and may be referred to as the pre-pending state. "Mid-job" refers to activity occurring during rendering of part or all of the print job or while the raster image processor is rendering part or all of the print job. A "mismatch state" exists in the job state when there is a mismatch between the job attributes and the available printer resources or capabilities.

Figure 1:
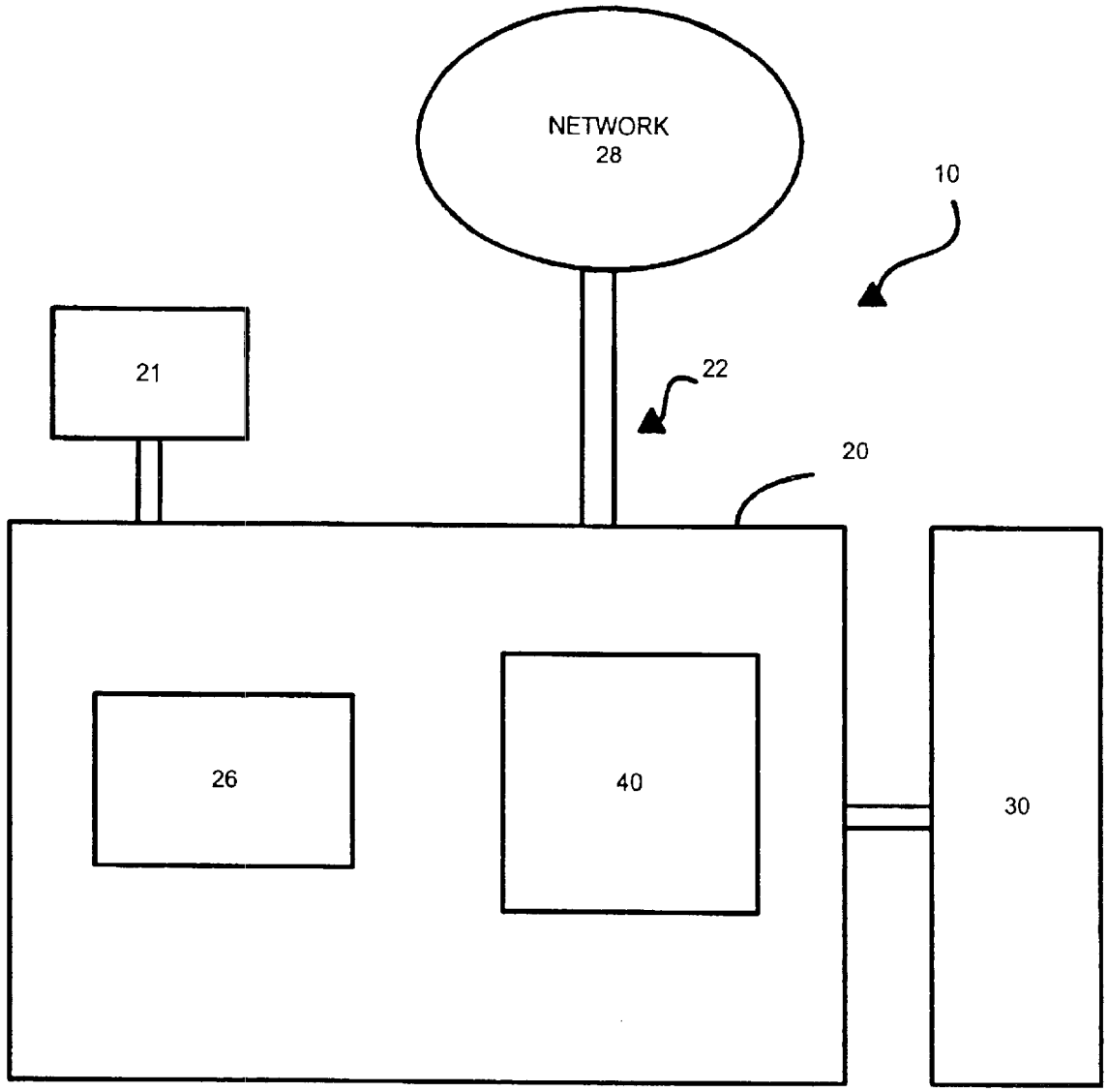
FIG. 1 is a print system that may be used to resolve mismatches using a user interface screen.

FIG. 1 is a print system that may be used to resolve mismatches using a user interface screen. As shown in FIG. 1, the print system 10 includes a printer 20 having a user interface 21 and network interface 22 connecting the printer 20 to a network 28. The printer 20 includes a raster image processor 26 that receives incoming data from the network 28. The printer 20 also includes a marking engine 40, that incorporates a plurality of available media supplies, and other standard paper handling and processing equipment necessary, for example, for producing printed images on output paper. Additionally, the printer 20 may be connected to one or more finishing devices 30 such as stapler, stacker, booklet maker, 3-hole punch and the like.

While the exemplary print system 10 shown is a network printing system intended to receive remote input through a network connection, other configurations are contemplated and possible within the scope of the present invention. For example, the printing system could be a stand-alone printer, including a scanner for on-site image input. Additionally, the printer could be connected to a scan workstation, with the calculated layout displayed for operator approval upstream of the printer. While a particular printer configuration is discussed herein, it is to be understood that the present invention may be incorporated in other printing system configurations. Moreover, while term "printer" is used throughout this discussion, it is to be understood that the present invention applies as well to electrographic copiers and all references to "printers" herein are to be understood to include copiers, as well.

In processing a print job, the printer may detect a mismatch. The mismatch may be, for example, a pre-job mismatch or a mid-job mismatch. In detecting the mismatch, the printer may receive a print job from a network, and the printer may then parse a print job header in order to determine print job attributes. Next, the printer may perform a pre-job mismatch check to determine whether there is a mismatch between any of the print job attributes specified in the job header and the available printer resources and capabilities. In practice, the pre-job mismatch check is a series of inquiries, one directed to each of the job attributes specified in the job header to determine whether the printer is capable of supporting that particular attribute. A negative response to any of the inquiries indicates a mismatch. In response to the mismatch, the printer may place the print job on hold pending resolution of the mismatch.

Not all mismatches can be detected prior to rendering (or rasterizing), however, because printer resources may change while the job is being rendered or because a printer may render the job and begin to print before the rendering is complete for the entire job, or because some jobs may not list all required printer resources before page one, i.e., in the job header. Therefore, such a mismatch of printer resources and job attributes may be discovered only after the job is partially rendered. Thus, at some point during rendering, it will become apparent that the entire job will not print properly because of a mismatch state that was not detected prior to rendering. After this point, further rendering is waste of time and printer processor resources.

While the following is not intended to be an exhaustive list, some examples of specific mid-job mismatches include an illegal combination of media sizes being sent to a finishing device that won't tolerate that particular combination, e.g., ledger-sized media sent to a booklet maker after earlier pages of the job have specified letter-sized media. The booklet maker is unable to process such a combination of media sizes, creating a mismatch. In this example, the job header may have specified letter-sized media, but individual pages in the job specified ledger-sized media. A second example of a mid-job mismatch may be caused by an illegal media size being sent to a finishing device that is unable to process media of the requested size, e.g., the print job specifies that a ledger sized page is to be sent to a stapler but the stapler is unable to process ledger sized media. A third example is where a print job includes a request for a finishing device that has not been installed on the printer, e.g., a particular page is to be directed to a booklet maker but the printer does not have a booklet maker installed. Finally, a mid-job mismatch may result from a request for a finishing operation that the finishing device to which the page is directed cannot perform, e.g., a page directed to a stacker requests stapling when the stacker has no stapling capabilities.

Presently, should a currently available printer discover a mismatch, the printer typically displays an error message indicating the existence of a mismatch. The printer may additionally display information about the nature of the mismatch. While the displayed information may describe the mismatch, it typically does not provide any information on how to resolve the mismatch. Thus, the printer operator is left to determine, based on the nature of the mismatch, an appropriate action, if any is available, to resolve the mismatch. This can be a time consuming process, and potentially more so for inexperienced printer operators. Determining how to resolve the mismatch may involve matching resources needed by the print job against the available capabilities of the printer. Thus, for a resource that is requested by the print job but not currently available on the printer (e.g., thereby causing a mismatch), the printer operator determines if the printer can be configured to provide the resource or determines an acceptable substitute for the resource. The printer operator may then resolve the mismatch by reconfiguring the printer or by selecting the alternative resource. Once the mismatch is resolved, the printer operator then notifies the printer of the resolution, and the printer may then resume the print job. If, however, the printer operator determines that the mismatch cannot be resolved, then the printer operator may cancel the print job.

If the printer does not detect a pre-job mismatch (or alternatively after the printer operator resolves a pre-job mismatch), then the printer may begin to render each page of the job individually. As each page of the job is rendered the printer may perform inquiries for each page to determine whether any mismatch exists concerning the attributes of each individual page and the available printer resources and capabilities. If no mismatches are detected, the page is sent to the marking engine for printing, and this process may be repeated for each subsequent page. If no mismatches are detected on any of the pages of the job, after the entire job has been rendered and sent to the marking engine, then the printer prints the entire job. Alternatively, the pages may be printed as they are rendered, either as each page is rendered or in groups of pages, rather than rendering all of the pages before printing the entire job. However, during this process, the printer may detect a mid-job mismatch. If a mid-job mismatch is detected, the printer may place the job on hold without rendering the remaining pages of the print job pending the resolution of the mid-job mismatch.

In the case of mid-job mismatches, recovery may require the operator to change the print job attributes to conform to the printer resources available, and to completely re-render the print job. Thus, whether remedial action by the operator is possible is dictated by the conformation of the particular printer. For example, if the printer allows for operator modification of print job attributes, the operator may then re-configure the attributes and the job may be re-rendered and printed to completion. If the printer allows the operator to alter the print job attributes to remove the mismatch, the operator alters the print job attributes. This process may be repeated to resolve multiple mid-job mismatches.

Once the printer detects a mismatch, the printer may notify a printer operator of the mismatch using a user interface. In addition to providing notification of the mismatch using the user interface, the printer may also use the user interface to aid in resolving the mismatch. For example, the printer may use the user interface to present the printer operator with one or more options that may be used to resolve the mismatch. The options may be displayed, for example, in a hierarchical menu structure that the printer operator may browse. The printer operator may select one of the options, and based on the printer operator's selection, the printer takes the action specified by the selection in order to resolve the mismatch.

Figure 2:
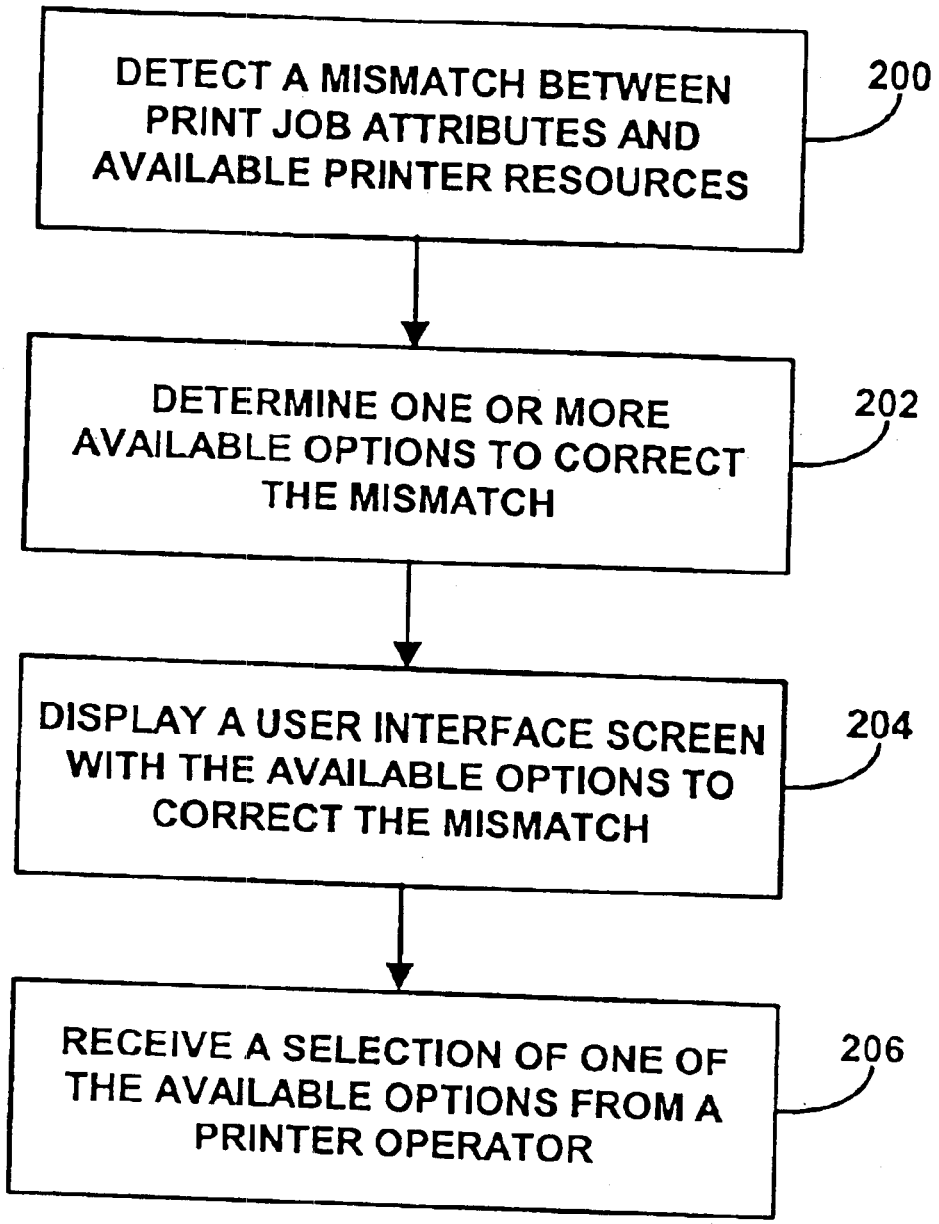
FIG. 2 is a flowchart of a process for using a user interface screen to resolve a printer mismatch.

FIG. 2 is a flowchart of a process for using a user interface screen to resolve a printer mismatch. At Step 200, the printer detects a mismatch between print job attributes and available printer resources. As previously described, the mismatch may be a pre-job mismatch or a mid-job mismatch. Then, at Step 202, the printer determines one or more available options to correct the mismatch. Of course, it is also possible that no action would resolve the mismatch, in which case the printer may terminate the print job or may notify the printer operator. The printer operator may in turn cancel the print job or may allow it to continue in spite of the mismatch. Next, the printer displays a user interface screen with the available options to correct the mismatch, as shown at Step 204. As previously described, the available options may be presented on the user interface in a hierarchical menu structure. Of course, other ways could also be used to display the options. Finally, at Step 206, the printer receives a selection of one of the available options from a printer operator.

Based on the selection, the printer then executes the directed action in order to correct the mismatch. It may be possible, however, that after executing the direct action, the mismatch may still be in effect. In this case, the printer may then re-notify the printer operator of the mismatch, such as by again displaying a notification of the mismatch on the user interface screen. Even if the mismatch is resolved, other mismatches may also be in effect. If other mismatches are still in effect, then the printer may display notification of these mismatches on the user interface screen. The printer operator may then use the user interface to select options in order to resolve these mismatches. Once these other mismatches are resolved, the printer may then proceed to complete the print job.

After detecting a mismatch, the printer may determine the available options to resolve the mismatch. This may be done in a variety of different ways. For example, the printer may be preprogrammed to associate a particular mismatch with one or more options that may be used to correct the mismatch, which may also be referred to as remediations. This list of potential remediations for each mismatch may be defined by a software developer, and thus programmed as defaults for the printer. However, the printer operator may choose to limit the potential remediations for a particular mismatch.

For instance, a particular mismatch may be configured as being able to be remediated via a particular mismatch option. A printer operator, however, may decide that the mismatch option is not a desirable operation for remediating that mismatch on that printer. The printer operator may then reconfigure the printer, such as by using a default configuration utility, to disable the display of that remediation option when the mismatch occurs on that printer. Subsequently, the printer would not list that remediation option for that mismatch, but it may list other programmed remediations. Of course, the printer operator may remove more than one remediation options for a particular mismatch. Additionally, the printer operator may re-enable one or more remediation options for a particular mismatch that were previously disabled.

The mismatches that occur in a printer and the possible remediations may vary with the type of printer. For example, they may vary with the number of media trays supported by the printer, the types of media supported by the printer, the finishing devices that may be attached to printer, the types of fonts supported by the printer, or a variety of other factors. Table 1 lists four exemplary mismatches, however it should be understood that these mismatches are merely exemplary in nature. Many other mismatches also exist, and thus a printer may potentially incur a fewer or greater number of mismatches. These additional mismatches may also be resolved using a user interface screen.

TABLE 1

| Mismatch Label | Mismatch Description |
|---|---|
| MMM_MEDIA | The job requires a media that is not loaded in any of the printer's media supply drawers |
| MMM_RIPSTORE_LICENSE_MISSING | The job is attempting to use a printer feature that the printer owner did not pay for |
| MMM_OPERATOR_MESSAGE | The job has a message for the operator that must be acknowledged before the job can be rendered |
| MMM_STAPLE_MEDIA_SIZE | The job is attempting to use a media size in a finishing device that does not support that size |

Table 2 lists seven exemplary remediations that may be used to resolve the mismatches described in Table 1. Table 2 lists a label for each remediation and a corresponding description of the remediation. Of course, it should be understood that these remediations are merely exemplary in nature, and many other remediations may also be used to resolve mismatches. Thus, a printer may use a greater or fewer number of remediations to resolve the various possible mismatches.

TABLE 2

| Remediation Label | Remediation Description |
|---|---|
| J1 PROOFSET_RELEASE | The job is mismatched because it has created a proof of the job and is waiting for the printer operator to release the job to create all the sets of the job |
| J2 HOLD_RELEASE | The job is held either by the printer operator or by some event such as a mid-job mismatch detection. The job requires permission from the operator to continue. |
| J3 HOLD2_RELEASE | Same as 'hold' but in this case the hold is caused by a special mode of the printer called the 'Security Mode.' The job requires permission from the operator to continue |
| J4 OPERATOR_MESSAGE_RELEASE | The job includes an operator message so it will remain mismatched until the operator acknowledges that the operator has received the message. |
| J5 MODIFY_JOB_SCREEN | The job has a mismatch that could be cleared by changing one or more attributes of the job. |
| J6 MODIFY_JOB_MEDIA_SCREEN | The job has a mismatch that could be cleared by changing one or more media of the job. |
| J7 IGNORE_MEDIA_MISMATCH | If the job requires a media that is not presently loaded in the printer, the operator can choose to ignore the missing media and render the job. When the job starts to print, however, then the printer's marking engine will again demand the missing media. |

Table 3 lists four exemplary printer system modifications. In Table 3, each modification is described by a label and a corresponding description. These printer system modifications may be used to resolve mismatches, such as by making a modification to the printer in order to potentially accommodate a print job requirement. Of course, it should be understood that these are merely exemplary in nature, and a printer may support additional modifications. The modifications that may be made to a printer will generally vary depending on the type of printer, but they may vary based on other factors as well.

TABLE 3

| Printer System Modification Label | Printer System Modification Description |
|---|---|
| P1 MICR_FONT_ENABLED | A special mode for the printer in which it is enabled to use magnetic ink character recognition ("MICR") fonts. P1 turns this mode on. |
| P2 FINISHING_DEVICE_ENABLE | Display a screen allowing the operator to enable one or more previously disabled finishing devices. |
| P3 CHANGE_LOADED_MEDIA | In conjunction with physically changing the media in one of the drawers, the operator configures the printer so that it knows the media's color, weight and type. |
| P4 CHANGE_TONER | This is a message to the operator requesting that a certain type of toner, which is required for the job, be loaded into the printer. The printer may detect the proper toner and clear the mismatch. |

Table 4 shows available remediations for each of the mismatches of Table 1. Of course, these remediations are merely exemplary in nature. Thus, each mismatch may be resolved using additional remediations. Alternative, for a particular printer system, some of the remediations listed in Table 4 may not be used to resolve the corresponding mismatch. Of course, the available remediations for a particular mismatch may be reconfigured by the printer operator, and the available remediations will ordinarily vary based on the type of printer as well as other factors. Also, as shown in Table 4, some mismatches may not have an available remediation, and thus may not be able to be resolved.

TABLE 4

| Mismatch Type | Available Remediations |
|---|---|
| MMM_MEDIA | P3, J6, J7 |
| MMM_RIPSTORE_LICENSE_MISSING | <NO REMEDIATION> |
| MMM_OPERATOR_MESSAGE | J4 |
| MMM_STAPLE_MEDIA_SIZE | J5, J6 |

Figure 3A:
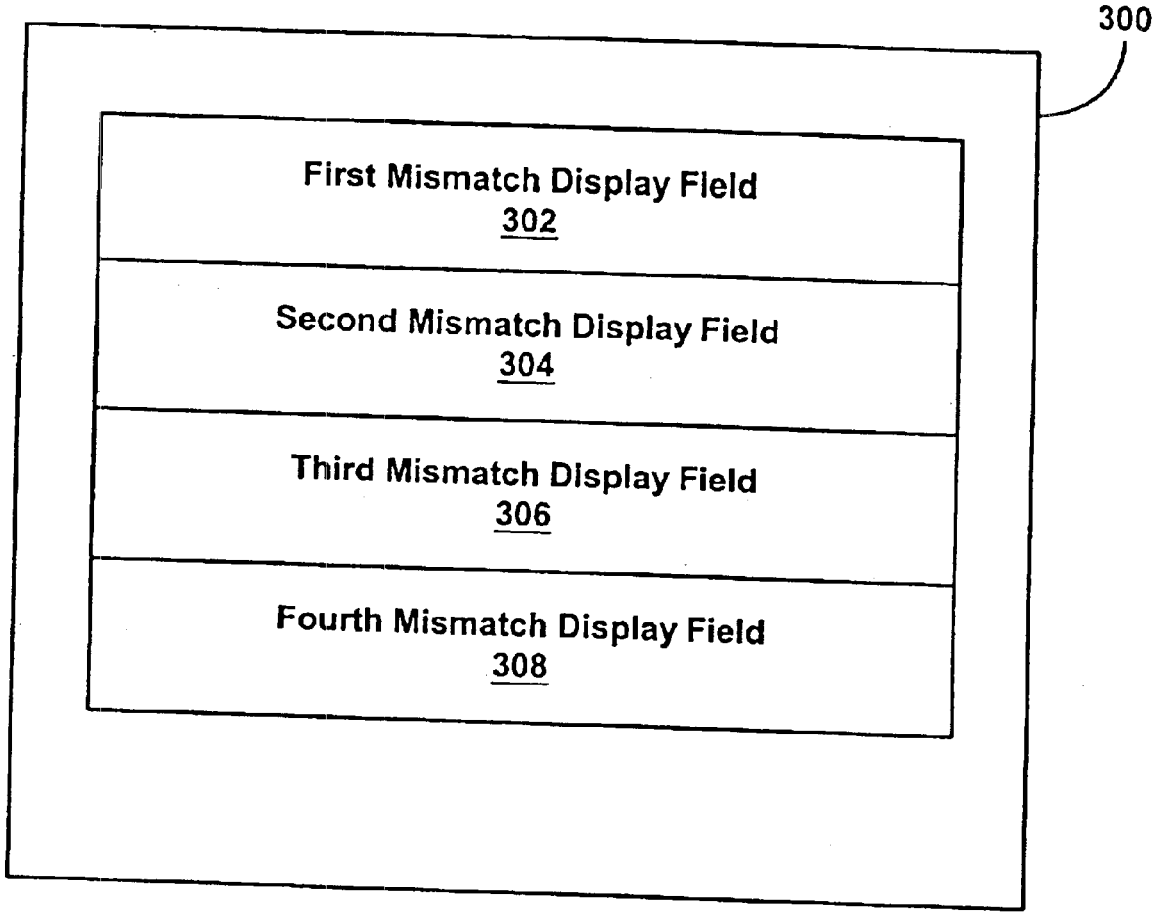
FIG. 3A is an embodiment of a user interface screen for displaying mismatches in which the user interface screen displays the mismatches in a first menu level.

FIG. 3A is an embodiment of a user interface screen for displaying mismatches in which the user interface screen displays the mismatches in a first menu level. FIG. 3A generally depicts a user interface screen 300, which may be used by the printer to display information. As shown in FIG. 3A, the user interface screen 300 displays information about four different mismatches. The user interface 300 displays a first mismatch display field 302, a second mismatch display field 304, a third mismatch display field 306 and a fourth mismatch display field 308. Each mismatch display field 302, 304, 306, 308 may display information about a respective mismatch, and, as shown in FIG. 3A, they collectively form a hierarchical menu structure. Thus, the first mismatch display field 302 displays information about a first mismatch; the second mismatch display field 304 displays information about a second mismatch; the third mismatch display field 306 displays information about a third mismatch; and the fourth mismatch display field 308 displays information about a fourth mismatch.

Each mismatch display field 302, 304, 306, 308 may identify its respective mismatch, and it may describe a cause of the mismatch. Although, FIG. 3A depicts four mismatch display fields 302, 304, 306, 308, it should be understood that the user interface screen 300 may identify a greater or fewer number of mismatch display fields. For example, in processing a print job, a greater or fewer number of mismatches may occur. Thus, the user interface screen 300 may modify the number of mismatch display fields based on the number of mismatches that occur in processing the print job. The user interface screen 300 may also be dynamically updated as mismatches occur in processing the print job or as mismatches are resolved.

Using the menu structure, a printer operator may scroll among the different mismatch display fields 302, 304, 306, 308. Thus, the printer operator may see the various different mismatches that occur in processing the print job. The printer operator may then select one of the mismatches in order to see a list of available options to resolve the mismatch. Once the printer operator selects one of the mismatch display fields 302, 304, 306, 308, the user interface screen 300 may then display the list of available options corresponding to the selected user interface display.

Figure 3B:
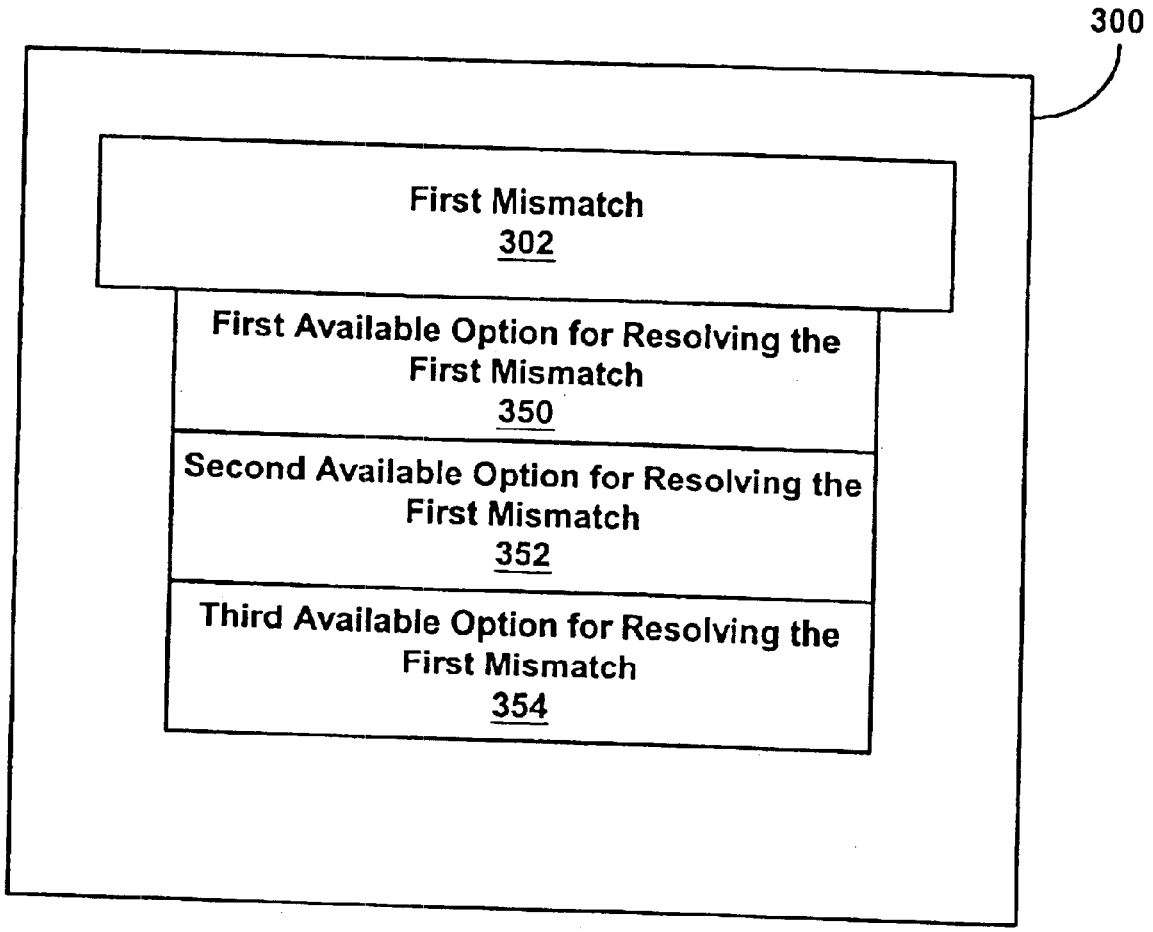
FIG. 3B is an embodiment of the user interface screen of FIG. 3A in which the user interface screen displays a second menu level showing available options for correcting one of the mismatches.

FIG. 3B is an embodiment of the user interface screen of FIG. 3A in which the user interface screen displays a second menu level showing available options for correcting one of the mismatches. For example, the printer operator may select the first mismatch display field 302 from the first menu level depicted in FIG. 3A. The user interface screen 300 may then transition from the first menu level depicted in FIG. 3A to the second menu level depicted in FIG. 3B. As shown in FIG. 3B, the second menu level displays available options for resolving the first mismatch. Of course, had the printer operator selected one of the other mismatches, the user interface screen 300 may appropriately display a second menu level that shows the available options for resolving that mismatch.

FIG. 3B displays the first mismatch display 302. Under the first mismatch display 302, the user interface screen 300 displays three additional fields. A first field 350 corresponds to a first available option for resolving the first mismatch; a second field 352 corresponds to a second available option for resolving the first mismatch; and a third field 354 corresponds to third available option for resolving the first mismatch. Of course, the user interface screen 300 may display a greater or fewer number of fields. For example, the printer may determine that a greater or fewer number of options exist for resolving the mismatch. Thus, the user interface screen 300 may display a greater or fewer number of fields corresponding to the number of available options that may be used to resolve the first mismatch.

Once the available options are displayed, the printer operator may then select from among the available options in order to resolve the mismatch. For example, the printer operator may use an input device, such as a mouse or keypad, to scroll among the available options and to select one of the options. After selecting one of the fields 350, 352, 354, and thereby one of the available options for resolving the mismatch, the printer may execute the directed operation to resolve the mismatch.

In an alternate embodiment, one or more of the fields 350, 352, 354 may include one or more sub-menus. For example, by selecting one of the fields, the user interface screen 300 may display a sub-menu for the available option. The sub-menu may correspond to, for example, additional configuration options to be selected in resolving the mismatch. Of course, options in the sub-menu may also correspond to one or more sub-menus. The hierarchical menu may include any number of menu level, and it should not be limited to only those levels previously described. Once the printer operator has exhausted the sub-menus, or otherwise selected a terminal option (i.e., one that does not correspond to more sub-options), the printer may resolve the mismatch using the printer operator's selections.

In an alternate embodiment, one or more of the available options may correspond to an action that may only be performed by the printer operator. For example, changing the media while the printer is running, adding toner while the printer is running, adding a finishing device or other such operations cannot be performed by the printer itself. In this case, selecting that available option may simply indicate to the printer that the printer operator has taken the necessary action. Thus, by selecting the option, the printer may proceed to finish the print job without taking any further corrective action. Of course, if the printer operator selects that available option without first performing the corrective action, the printer may attempt to proceed with the print job but since the corrective action was not taken the printer may redetect the same mismatch.

Figure 4:
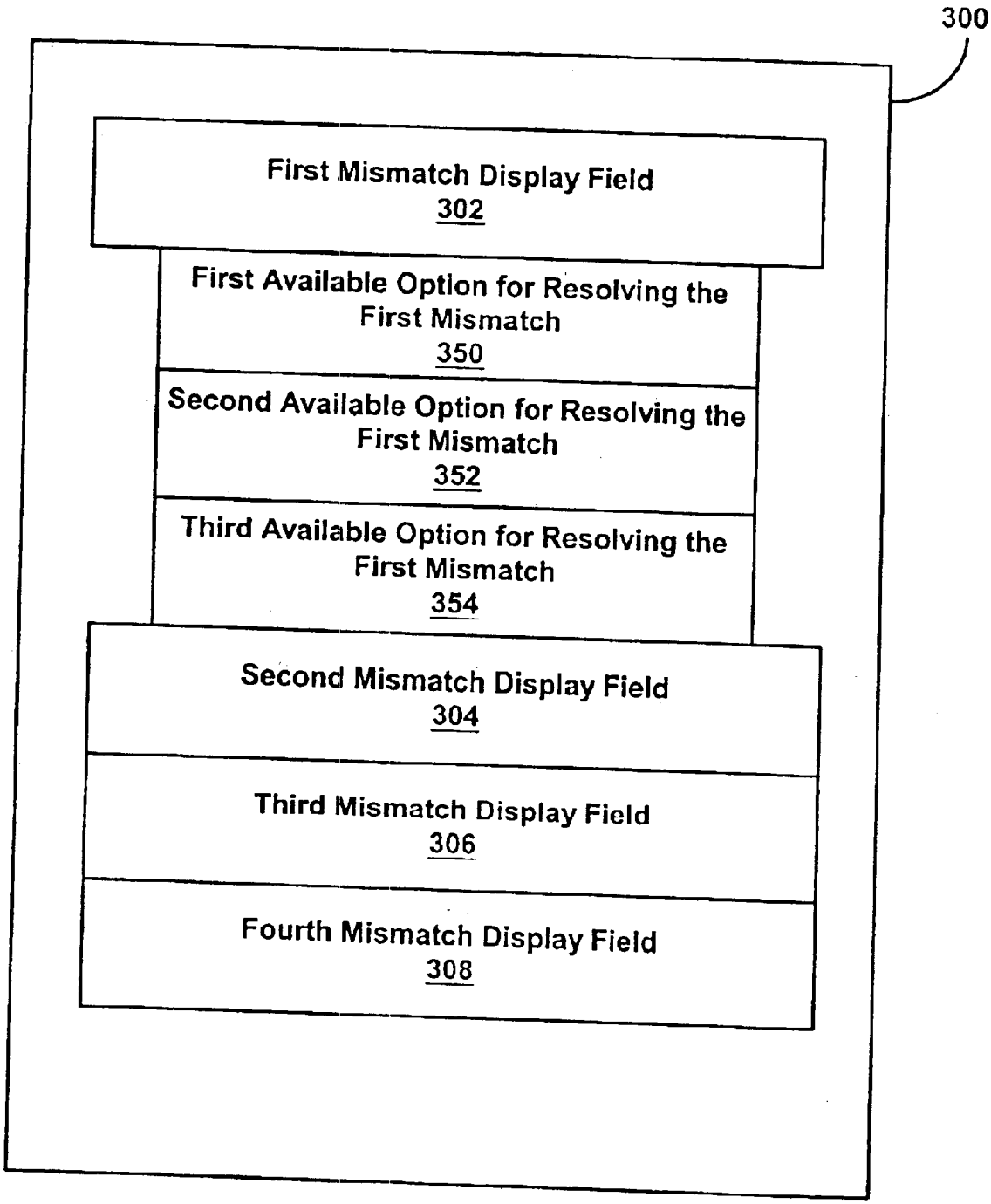
FIG. 4 is an alternate embodiment of the user interface screen of FIG. 3A in which the user interface screen simultaneously displays first and second menu levels.

FIG. 4 is an alternate embodiment of the user interface screen of FIG. 3A, in which the user interface screen simultaneously displays first and second menu levels. FIG. 4 depicts an alternate display format for showing the first and second menu levels. For example, the printer operator may again select the first mismatch display field 302 of FIG. 3A. Instead of transitioning to only displaying the second menu level, as was depicted in FIG. 3B, the user interface screen 300 may display the available option fields 350, 352, 354 as a dropdown menu while still displaying the other mismatch display fields 304, 306, 308.

Figure 5:
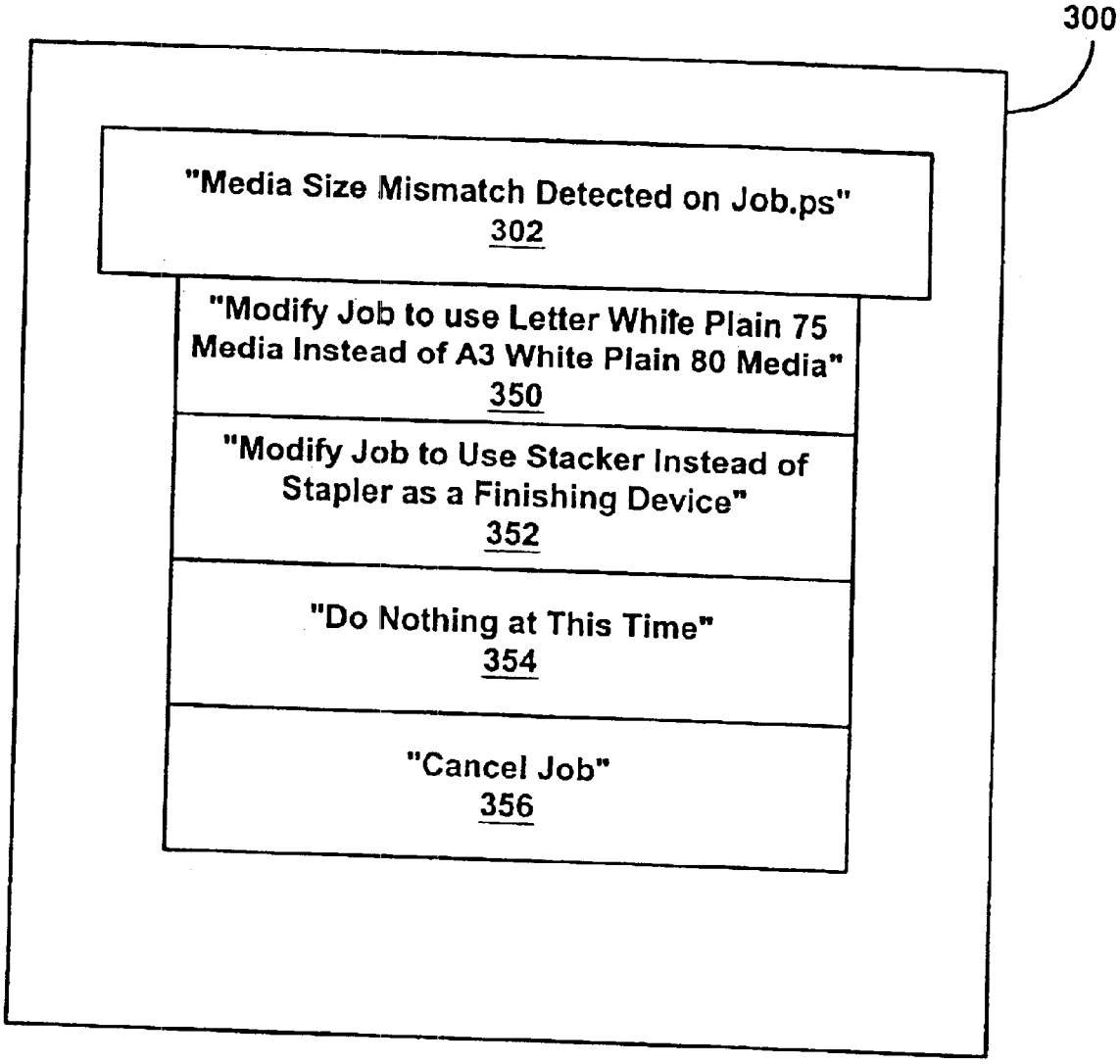
FIG. 5 is an embodiment of the user interface screen of FIG. 3B in which the user interface screen displays available options for resolving a mismatch that occurs when a large media size is sent to a finishing device that cannot handle large media sizes.

FIG. 5 is an embodiment of the user interface screen of FIG. 3B in which the user interface screen displays available options for resolving a mismatch that occurs when a large media size is sent to a finishing device that cannot handle large media sizes. For example, a mismatch may occur if the print job attempts to send a large media size into a finishing device that does not support large media sizes. In this specific example, the print job attempts to send an A3 sized media into a stapler finishing device that does not support that size of media. The printer detects that a mismatch has occurred, and then determines available options for resolving the mismatch. The printer then displays the mismatch, and the printer operator selects the mismatch in order to view available options for resolving the mismatch.

As shown in FIG. 5, the printer then displays a menu on the user interface screen 300 that shows the available options for resolving the mismatch. The format of the display of FIG. 5 is similar to that of FIG. 3B, but other display formats may be used as well. As shown in FIG. 5, the user interface screen 300 displays the first mismatch display field 300. The first mismatch display field 300 displays the text "Media Size Mismatch Detected on Job ps." Under the first mismatch display field 300 are the available option fields 350, 352, 354, 356 corresponding to the four available options for correcting this mismatch.

The first available option field 350 displays the text "Modify Job to Use Letter White Plain 75 Media Instead of A3 White Plain 80 Media." The second available option field 352 displays the text "Modify Job to Use Stacker Instead of Stapler as Finishing Device." The third available option field 354 displays the text "Do Nothing at This Time." The fourth available option field 356 displays the text "Cancel Job." The text in each field corresponds to the four available options for resolving this mismatch, which are to user a different paper size, to use a different finishing device, to do nothing, or to cancel the print job. The printer operator may then select one of the options to resolve the mismatch. Once selected, the printer executes certain steps for resolving the mismatch, thereby relieving the printer operator from having to perform the steps himself.

If the printer operator selects one of the first two options, the print job will likely complete printing, unless of course other mismatches occur or the job is otherwise interrupted or cancelled. If the printer operator selects the third option, then the job will also continue. However, since the media size does not match the finishing device, a jam or other error may occur. If the printer operator selects the fourth option, then the print job is cancelled and does not continue printing. It may, however, be resubmitted to the printer at a later time.

In an alternate embodiment, selecting one of the available option fields 350, 352, 354, 356 may present the printer operator with one or more other choices. For example, the first available option field 350 may display the text "Modify Job to Use Different Media." Then, in response to selecting this option field 350, the printer may display another screen showing one or more media choices to replace the mismatched media. The printer operator may then select one of the media choices in order to resolve the mismatch. Of course, other fields may present other sub-options as well.

Figure 6:
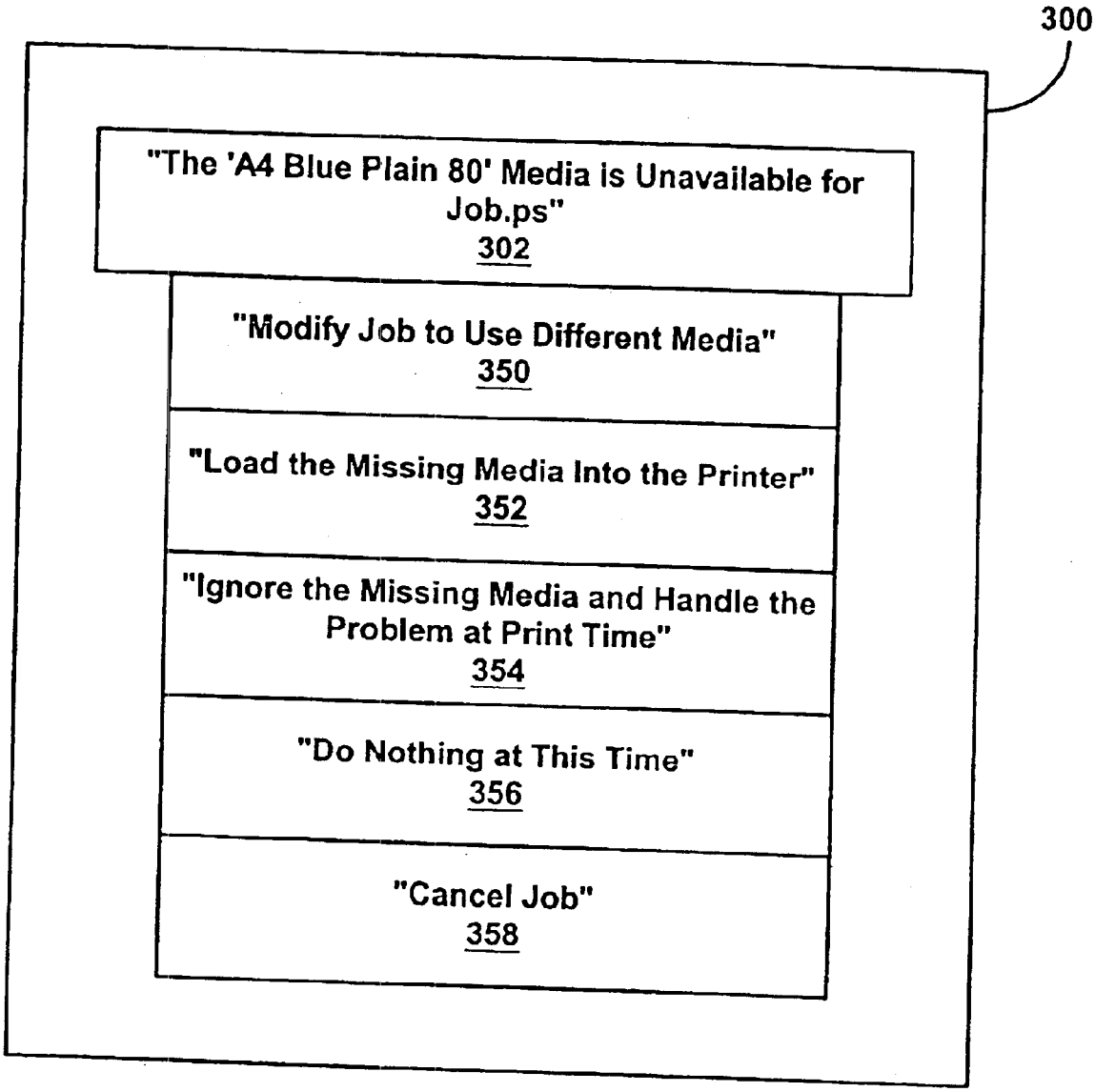
FIG. 6 is an embodiment of the user interface screen of FIG. 3B in which the user interface screen displays available options for resolving a mismatch that occurs when a print job attempts to use a media that is not loaded into the printer.

FIG. 6 is an embodiment of the user interface screen of FIG. 3B in which the user interface screen displays available options for resolving a mismatch that occurs when a print job attempts to use a media that is not loaded into the printer. In this example, a mismatch occurs because the print job attempts to use "A4 Blue Plain 80" media, but that media type is not currently loaded in to the printer. In response to the mismatch, the printer may display the mismatch on the user interface screen, and the printer operator may select the mismatch in order to view the available options for resolving the mismatch.

As shown in FIG. 6, the user interface screen 300 may then display the available options for correcting the mismatch. For this mismatch, five options are available. The printer operator may load the media into the printer, the print job may be modified to use a different media type, the problem may be ignored and handled at print time, the problem may be ignored, or the print job may be cancelled. The five available option fields 350, 352, 354, 356, 358 display the available options for correcting the mismatch.

The first available option field 350 displays the text "Modify Job to Use Different Media"; the second available option field 352 displays the text "Load the Missing Media Into the Printer"; the third available option field 354 displays the text "Ignore the Missing Media and Handle the Problem at Print Time"; the fourth available option field 356 displays the text "Do Nothing at This Time"; and the fifth available option field 358 displays the text "Cancel Job." Of course, other labels may also be used to identify the available options for correcting the mismatch.

Figure 7:
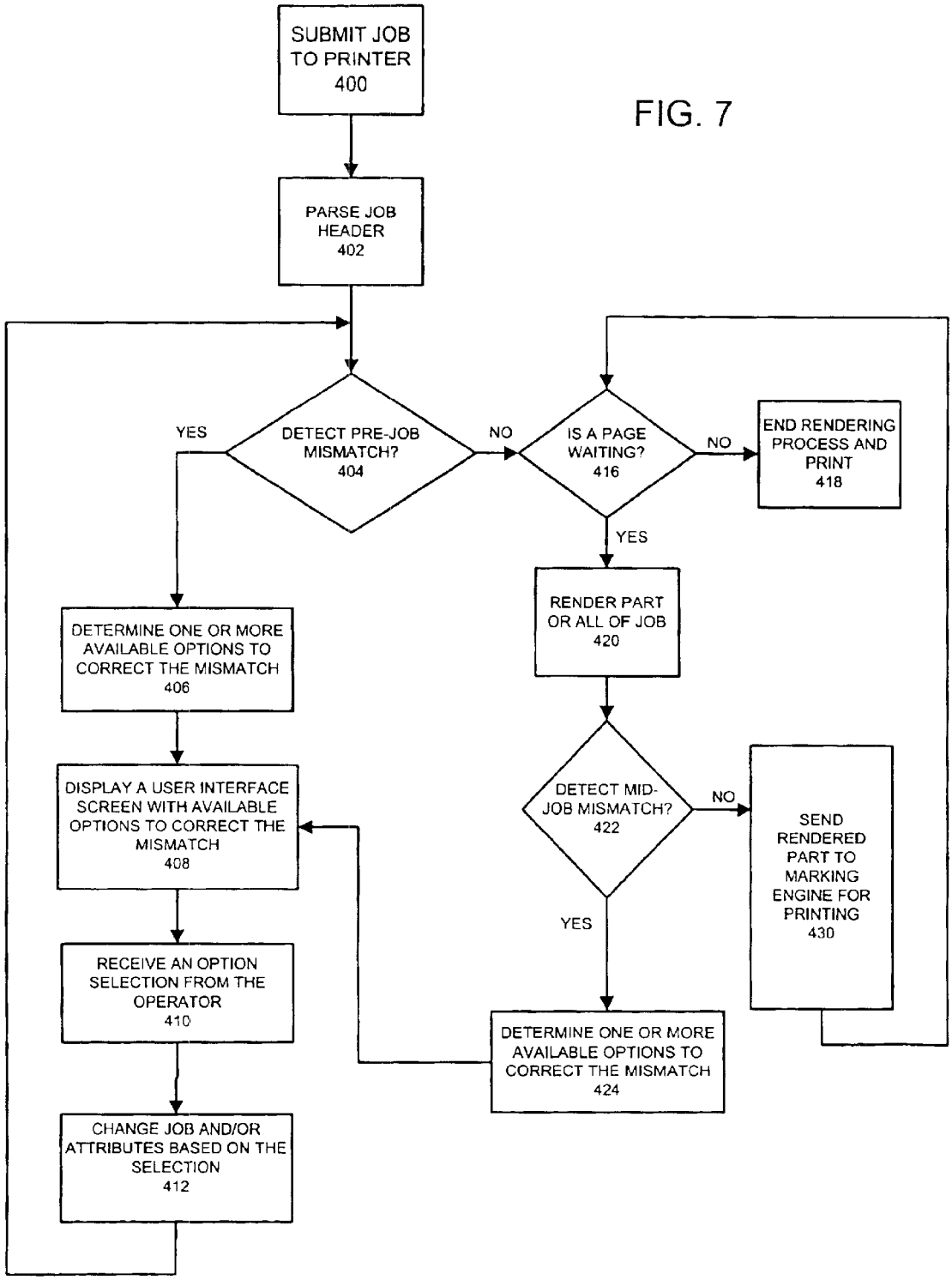
FIG. 7 is a flow chart for using a user interface screen to resolve printer mismatches.

An embodiment of the method of the present invention is demonstrated by the flowchart depicted in FIG. 7. The method includes receiving a print job from the network at Step 400. In Step 402 the print job header is parsed, and the print job attributes determined. Step 404 is a pre-job mismatch check, and inquires whether there is a mismatch between any of the print job attributes specified in the job header and the available printer resources and capabilities. In practice, the pre-job mismatch check is a series of inquiries, one directed to each of the job attributes specified in the job header to determine whether the printer is capable of supporting that particular attribute. If an affirmative response is received to the inquiry of Step 404, then a Step 406 initiates a mismatch state in which the printer determines one or more available options to correct the mismatch. In a Step 408, the printer displays a user interface screen with the available options to correct the mismatch. As previously described, the available options may be presented on the user interface in a hierarchical menu structure. Of course, other ways could also be used to display the options. At a Step 410, the printer receives a selection of one of the available options from a printer operator. Based on the selection, at a Step 412 the printer then executes the directed action in order to correct the mismatch by changing the job attributes. Once the job attributes resolve the mismatch, the routine returns to step 404 for further mismatch detection. Of course, it is also possible that no action would resolve the mismatch, in which case the printer may terminate the print job or may notify the printer operator. The printer operator may in turn cancel the print job or may allow it to continue in spite of the mismatch.

Software code used to implement mid-job mismatch detection can be summarized by a brief example. Several definitions are necessary to understand the following example. A "log_i18n message" is a function used to notify the user of a given condition via a printer user interface or log file. The "isLegalPage" function checks to determine if the page size is a legal size, that is, whether the page size is one supported and supplied by the printer. This function checks each page header to detect specified media sizes that are unsupported by the printer. Code for the "isLegalPage" function is set forth in Table 5.

TABLE 5

```
*/
T_bool
PageQueue::isLegalPage( CDH_Page_Information* new_p, char * explanation_p)
{
    assert( new_p );
    assert( mPage_p->mReq_p);
    T_bool legal_page = TRUE;
    CDH_Page_Information* old_p = getPgInfoTail( );
    // first page of a job
    if(old_p == 0) {
        // set media sizes to the values of the first page header of the job.
        mInTrack = new_p->header.media.x;
        mCrossTrack = new_p->header.media.y;
    {
    // If first page, or if this page differs from the previous...
    if(old_p == 0
        || new_p->header.media.x != old_p->header.media.x
            || new_p->header.media.y != old_p->header.media.y
            || new_p->header.interleaf_media.x != old_p->header.interleaf_media.x
            || new_p->header.interleaf_media.y != old_p->header.interleaf_media.y
            || new_p->header.output_destination != old_p->header.output_destination
            || new_p->header.useModalFinishing != old_p->header.useModalFinishing
            || mFinishingOperations.isChangedFinishingOperationInPageHeader( old_p-
>header, new_p->header ))) {
        // assume destination is job destination unless proven otherwise
        Mec_Output_Option pageDestination = mPage_p->mReq_p->OutputMedia;
        if (new_p->header.output_destination != ME_DEFAULT_OUTPUT) {
            pageDestination = new_p->header.output_destination;
        }
        // get finishing device object
        FinishingDevice& finDev = mFinishingDeviceList.getFinishingDevice(
pageDestination );
        // verify destination is connected and enabled
        if ( !finDev.isPresentAndActivated( ) ) {
            sprintf(explanation_p, "%s is either deactivated or not present.",
                finDev.getName( ) );
            legal_page = FALSE;
            mJob.addMidJobMismatch( MMM_OUTPUT_MISSING, new_p-
>header.page_number,pageDestination);
            }
            // verify that the finishing device in use will work with the present media:
            if ( !finDev.isMediaSizeCapable( new_p->header.media.x,
            new_p->header.media.y)
){
            sprintf(explanation_p, "Invalid media for %s.", finDev.getName( ) );
            legal_page = FALSE;
            mJob.addMidJobMismatch( MMM_MEDIA_SIZE,
            new_p->header.page_number,
pageDestination );
            {
            // verify that the mix of media in this job will work in this finishing device.
            if( old_p, !=0
                && ((finDev.isConstantInTrack( ) &&
```

TABLE 5-continued

```
                    ( new_p->header.media.x != mInTrack ))
                      || (finDev.isConstantCrossTrack( ) && (new_p->header.media.y !=
mCrossTrack )))) {
                sprintf(explanation_p, "Invalid media mix for %s.", finDev.getName( ) );
                legal_page = FALSE;
                mJob.addMidJobMismatch( MMM_MEDIA_SIZE_MIX, new_p-
>header.page_number, pageDestination );
}
          // verify that the finishing device in use can execute the finishing
          operations required.
          if ( mFinishingOperations.isIlegalFinishingOperation( new_p->header, finDev )) {
               sprintf(explanation_p, "Illegal %s finishing operation.", finDev.getName ( ) );
               legal_page = FALSE;
               mJob.addMidJobMismatch( MMM_ILLEGAL_FINISHING_OPERATION,
new_p->header.page_number, pageDestination );
               }
               // verify that no attempt is made to punch an unpunchable media
               if (( new_p->header.punchPattern !=0)
                    && ( new_p->header.media.isUnpunchable )) {
                    mJob.addMidJobMismatch( MMM_INOPERABLE_MEDIA, new_p-
>header.page_number, ME_HOLE_PUNCH );
          }
     }
     if ( !legal_page ) {
          log_il8n_message( "FATAL_ERROR_PAGE",
          new_p->paper_exception_page );
     }
     return legal_page;
} /* endfunc isLegalPage( ) */
```

The "isLegalFinishingOperation" function tests to see if a page specifies a certain finishing device or operation that is not supported by the printer. Code for the "isLegalFinishingOperation" function is set forth in Table 6.

TABLE 6

```
T_Bool
FinishingOperations::isIlegalFinishingOperation( const Jm_Page_Header& newPH, const
FinishingDevice& finDev)
{
     return ( ((newPH.staple_position == SP_STAPLES_TOP
          ||newPH.staple_position == SP_STAPLES_BOTTOM
          ||newPH.staple_position == SP_STAPLES_BOTH)
          && !finDev.isFinOpCapable( FINOP_STAPLE))
          ||( newPH.isJog          && !finDev.isFinOpCapable( FINOP_STACK) )
          ||( newPH.staple_position == SP_STAPLES_SADDLE)
               && (!finDev.isFinOpCapable( FINOP_SADDLE_STITCH )))
          ||( newPH.isTrim         && !finDev.isFinOpCapable( FINOP_TRIM))
          ||( newPH.isFold         && !finDev.isFinOpCapable( FINOP_SADDLE_FOLD
))
          // hole punch not yet handled until inline finishing devices can communicate with
the destination finishing devices.
          // ||( ( newPH.punchPattern != 0) && !finDev.isFinOpCapable(
FINOP_HOLE_PUNCH))
          );
}
void
```

Finally, the "addMidJobMismatch" function records the nature of the mismatch and the page on which the mid-job mismatch occurred, and is the first step in a series of functions and processes that eventually result in a message being displayed on the user interface. Code for the addMidJobMismatch function is set forth in Table 7.

TABLE 7

```
Job::addMidJobMismatch( Mismatch_Reason mismatch_reason, Uint16 pageNum,
Mec_Output_Option output)
{
    assert( output != ME_DEFAULT_OUTPUT && "Job::addMidJobMismatch");
    assert( pageNum > -1 && "Job::addMidJobMismatch");
    Mismatch::setMismatch ( &mJobQueueEntry.record[0], mismatch_reason);
    mJobQueueEntry.midJobMismatchPageNumber    = pageNum;
    mJobQueueEntry.midJobDevice                = output;
    mMismatch.display_current_match( &mJobQueueEntry.record[0], "midjob mismatch"
);
```

It may be possible, however, that after changing job and/or printer attributes, the mismatch may still be in effect. In this case, the printer may then re-notify the printer operator of the mismatch, such as by again displaying a notification of the mismatch on the user interface screen. Even if the mismatch is resolved, other mismatches may also be in effect. If other mismatches are still in effect, then the printer may display notification of these mismatches on the user interface screen. The printer operator may then use the user interface to select options in order to resolve these mismatches.

If a negative response is received to the inquiry in Step 404, then a query is made as to whether there are any portions (i.e. pages) of the print job waiting to be rendered in a Step 416. If not, then the rendering process is ended and the job is printed in a Step 418. If there are pages to be rendered, Step 420 begins to render part or all of the job, for instance by rendering each page of the job individually. As each page of the job is rendered by Step 420, Step 422 inquires for each page, whether any mid-job mismatch exists concerning the attributes of each individual page and the available printer resources and capabilities. If no mismatches are detected, the page is sent to the marking engine for printing in Step 430, and Step 416 is then repeated for each page. If a mid-job mismatch is detected, then a Step 424 initiates a mid-job mismatch state in which the printer determines one or more available options to correct the mismatch. Step 408 is then initiated. Pages may be printed as they are rendered, or in groups of pages, or all of the pages may be rendered before printing the job.

It is to be noted that the available options in Step 424 may overlap with the available options in Step 406.

It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. While various elements of the embodiments have been described as being implemented in software, in other embodiments hardware or firmware implementations may alternatively be used, and vice-versa.

In view of the wide variety of embodiments to which the principles of the present invention can be applied, it should be understood that the illustrated embodiments are exemplary only, and should not be taken as limiting the scope of the present invention. For example, the steps of the flow diagrams may be taken in sequences other than those described, and more, fewer or other elements may be used in the block diagrams.

The claims should not be read as limited to the described order or elements unless stated to that effect. In addition, use of the term "means" in any claim is intended to invoke 35 U.S.C. §112, paragraph 6, and any claim without the word "means" is not so intended. Therefore, all embodiments that come within the scope and spirit of the following claims and equivalents thereto are claimed as the invention.

What is claimed is:

1. A method of printing comprising the steps of:

submitting a print job having job attributes to a printer;

detecting a mid-job mismatch between the print job attributes and the available printer resources;

determining one or more available options to resolve the mismatch;

displaying available remediation options on a user interface for a print operator to select from;

receiving a selection of at least one of the available options from the print operator; and executing the selected option(s).

2. A method in accordance with claim 1, wherein the displaying step comprises displaying a hierarchical menu structure.

3. A method in accordance with claim 1, further comprising the step of repeating the detecting, determining, displaying and executing steps more than once in order to resolve multiple mid-job mismatches.

4. A method in accordance with claim 1, further comprising the step of reconfiguring the printer to disable display of a remediation option.

5. A method in accordance with claim 1, wherein there is no available remediation option.

6. A method in accordance with claim 1, wherein the displaying step comprises displaying multiple mismatch display fields.

7. A method in accordance with claim 1, wherein the displaying step comprises dynamically updating the user interface.

8. A method in accordance with claim 1, wherein the submitting step is done through a network interface.

9. A printing system for submitting a print job having job attributes to a printer comprising:

a processor for detecting a mid-job mismatch between the print job attributes and the available printer resources and determining one or more available options to resolve the mismatch;

a user interface for displaying available remediation options for a print operator permitting the operator to select from at least one of the available options in order to execute the selected option(s).

10. A printing system in accordance with claim 9, wherein the user interface displays a hierarchical menu structure.

11. A printing system in accordance with claim 9, wherein the processor detects multiple mid-job mismatches.

12. A printing system in accordance with claim 9, wherein a selected option is to reconfigure the printer to disable display of a remediation option.

13. A printing system in accordance with claim 9, wherein there is no available remediation option.

14. A printing system in accordance with claim 9, wherein the user interface displays multiple mismatch display fields.

15. A printing system in accordance with claim 9, wherein the user interface is dynamically updated.

16. A printing system for submitting a print job having job attributes to a printer comprising:

a processor means for detecting a mid-job mismatch between the print job attributes and the available printer resources and determining one or more available options to resolve the mismatch;

a user interface means for displaying available remediation options for a print operator permitting the operator to select from at least one of the available options in order to execute the selected option(s).

17. A printing system in accordance with claim 16, wherein the user interface means displays a hierarchical menu structure.

18. A printing system in accordance with claim 16, wherein the processor means detects multiple mid-job mismatches.

19. A printing system in accordance with claim 16, wherein a selected option is to reconfigure the printer to disable display of a remediation option.

20. A printing system in accordance with claim 16, wherein there is no available remediation option.

21. A printing system in accordance with claim 16, wherein the user interface means displays multiple mismatch display fields.

22. A printing system in accordance with claim 16, wherein the user interface means is dynamically updated.

23. A method of printing comprising the steps of:

submitting a print job having job attributes to a printer;

rendering part of the print job detecting a mismatch between the print job attributes and the available printer resources for the part of the print job that was rendered;

determining one or more available options to resolve the mismatch;

displaying available remediation options on a user interface for a print operator to select from;

receiving a selection of at least one of the available options from the print operator; and executing the selected option(s).

24. A method in accordance with claim 23, wherein the displaying step comprises displaying a hierarchical menu structure.

25. A method in accordance with claim 23, further comprising the step of repeating the detecting, determining, displaying and executing steps more than once in order to resolve multiple mid-job mismatches.

26. A method in accordance with claim 23, further comprising the step of reconfiguring the printer to disable display of a remediation option.

27. A method in accordance with claim 23, wherein there is no available remediation option.

28. A method in accordance with claim 23, wherein the displaying step comprises displaying multiple mismatch display fields.

29. A method in accordance with claim 23, wherein the displaying step comprises dynamically updating the user interface.

30. A method in accordance with claim 23, wherein the submitting step is done through a network interface.

31. A method in accordance with claim 23, wherein a part comprises one page.

* * * * *